US005113226A

United States Patent [19]

Tadokoro et al.

[11] Patent Number: 5,113,226

[45] Date of Patent: May 12, 1992

[54] IMAGE TRANSFER APPARATUS

[75] Inventors: Hiroyuki Tadokoro; Kazuhiro Wakamatsu, both of Hitachi; Syoji Sagae, Hitachiota; Akira Shimada, Hitachi, all of Japan

[73] Assignee: Hitachi, Ltd., Tokyo, Japan

[21] Appl. No.: 592,663

[22] Filed: Oct. 4, 1990

[30] Foreign Application Priority Data

Oct. 12, 1989 [JP] Japan ..... 1-264003

[51] Int. Cl.[5] ..... G03G 15/14

[52] U.S. Cl. ..... 355/273

[58] Field of Search ..... 355/271, 273, 274, 277, 355/279; 219/243, 244

[56] References Cited

U.S. PATENT DOCUMENTS 3,851,964 12/1974 Smith et al. ..... 355/279

FOREIGN PATENT DOCUMENTS 5990873 9/1984 Japan .

177374 9/1985 Japan ..... 355/271

6152672 3/1986 Japan .

6152674 3/1986 Japan .

6389870 9/1988 Japan .

*Primary Examiner*—A. T. Grimley

*Assistant Examiner*—Patrick J. Stanziene

*Attorney, Agent, or Firm*—Antonelli, Terry, Stout & Kraus

[57] ABSTRACT

A roller forms a curve in a sheet of recording paper to which a toner image, formed on the curved surface of a photosensitive drum, is transferred such that a transfer curve extends along the curved surface of a transfer drum. The roller is provided in a path for carrying the recording paper so as to be in contact with the transfer drum.

4 Claims, 1 Drawing Sheet

IMAGE TRANSFER APPARATUS

BACKGROUND OF THE INVENTION

The present invention relates to image transfer apparatus which transfer a toner image in an image recorder using electrophotographic techniques and, more particularly, to an image transfer apparatus which transfers a toner image formed on a primary recording medium to a secondary recording medium electrostatically drawn and supported to the surface of a transfer drum.

DESCRIPTION OF THE RELATED ART

An image recording apparatus using electrophotographic techniques obtains an image record by performing uniform charging, image exposing and developing operations on a surface of a photoconductive photosensitive drum which is a primary recording medium to form a toner image on the drum surface, transferring the toner image to recording paper which is a secondary recording medium, and heating the recording paper to which the toner image is transferred and fixing the toner image.

An image transfer apparatus which transfers a toner image on the photosensitive drum to recording paper, for example, disclosed in Japanese Patent Laid-Open Publication JP-A 61-52672, superimposes recording paper on the surface of a transfer drum covered beforehand with electric charges having the same polarity as those which the toner image has, applies charges having a polarity opposite to that of the charges which the toner image has to the surface of the recording paper to electrostatically draw the recording paper to the surface of the transfer drum, rotates the recording paper on the transfer drum synchronously with the photosensitive drum while keeping the recording paper in contact with the photosensitive drum under such condition to thereby electrostatically transfer the toner image on the photosensitive drum to the surface of the recording paper.

No engaging mechanisms such as a gripper for holding the recording paper on the surface of the transfer drum are required to be provided in the image transfer apparatus, so that recording paper can be easily and correctly positioned and held. Thus, this apparatus is suitable for color image recording for performing toner image transfer many times.

Furthermore, since the recording paper is electrically charged so as to have a polarity opposite to that of the toner image, the toner image transfer efficiency is high.

Also, in Japanese Patent Laid-Open Publication JP-A 61-52674, an image transfer apparatus is proposed which superimposes recording paper on the surface of a transfer drum covered beforehand with electric charges having a polarity opposite to that of electric charges which a toner image on the photosensitive drum has, applies electric charges having the same polarity as the electric charges which the toner image has to the surface of the recording paper to electrostatically draw same onto the surface of the transfer drum, and rotates the recording paper on the transfer drum synchronously with the photosensitive drum while keeping the recording paper in contact with the photosensitive drum under such condition to electrostatically transfer the toner image on the photosensitive drum to the surface of the recording paper.

Since an image recording apparatus of this type uses various types of recording paper, however, the use of a type of recording paper renders unstable (weakened) the electrostatic drawing of the recording paper to the transfer drum to thereby disable stabilized transfer of a toner image undesirably.

The weight of PPC recording paper (basis weight) which is a type of recording paper used in an electrophotographic recording apparatus is 75 g/m$^2$ in many cases. Sixty-ninety grams/m$^2$ PPC recording paper is commercially available in a general market. If 90 g/m$^2$ PPC recording paper is used, a large electrostatic force is required to electrostatically draw that recording paper onto a transfer drum securely, because it has a relatively high rigidity. If two types of electric charges opposite in polarity which bring about a large electrostatic force are applied to the transfer drum and recording paper respectively, electrical discharge would occur across the recording paper and the photosensitive drum to thereby undesirably disturb the toner image.

An environment in which an image recording apparatus of this type is used is in many cases a general office. Such office may have no air conditioning system in which case the image recording apparatus can be used under environmental conditions such as at a temperature of 30–35° C. in summer and at a humidity of 70–80% RH. Under such environmental conditions, recording paper would be humidified and its electrical resistance value would be reduced, so that the electric charges on the recording paper would early self-discharge and it is difficult to maintain an electrostatic force by which the recording paper is stably drawn electrostatically onto the transfer drum.

Therefore, it is an object of the present invention to electrostatically draw recording paper stably onto the transfer drum irrespective of the type of the recording paper and to obtain a preferable electric field for transfer of a toner image.

SUMMARY OF THE INVENTION

One of the features of the present invention is an image transfer apparatus in an image recorder in which a toner image is formed on a surface of a photosensitive drum as a primary recording medium by uniform charging, with image exposure and development, the toner image being transferred to a secondary recording medium electrostatically drawn to a transfer drum, and with the secondary recording medium to which the toner image is transferred being fixed to obtain an image record. A recording medium curving means forms, in the secondary recording medium which is carried toward the transfer drum, a curve extending along the outer peripheral surface of the transfer drum before the secondary recording medium is superimposed on the transfer drum.

Another feature is an image transfer apparatus in an image recorder in which a toner image is formed on a surface of a photosensitive drum as a primary recording medium by uniform charging, image exposure and development, with the toner image being transferred to a secondary recording medium drawn electrostatically to a transfer drum, and with the secondary recording medium to which the toner image being transferred is fixed to obtain an image record. Means are provided for drying the secondary recording medium which is carried toward the transfer drum before the same is superimposed on the transfer drum, and recording medium curving means forms, in the secondary recording medium, a curve extending along the outer peripheral surface of the transfer drum.

According to the present invention, since the recording medium is beforehand given a curve extending along the outer peripheral surface of the transfer drum, it is ensured that the recording medium is drawn electrostatically onto the outer peripheral surface of the transfer drum with a relatively small electrostatic drawing force. If the drying means is used, the recording medium is dried. Therefore, the electric charges applied to the recording medium are held for a relatively long time period and a stabilized electrostatic drawing force is maintained for a long time period.

Therefore, there is no need for applying excessive electric charges, so that a satisfactory toner image transfer characteristic is obtained.

BRIEF DESCRIPTION OF THE DRAWINGS

In drawings where an embodiment of the present invention is illustrated.

DESCRIPTION OF THE PREFERRED EMBODIMENT

A preferred embodiment of the present invention will now be described with reference to the drawings.

Figure 1:
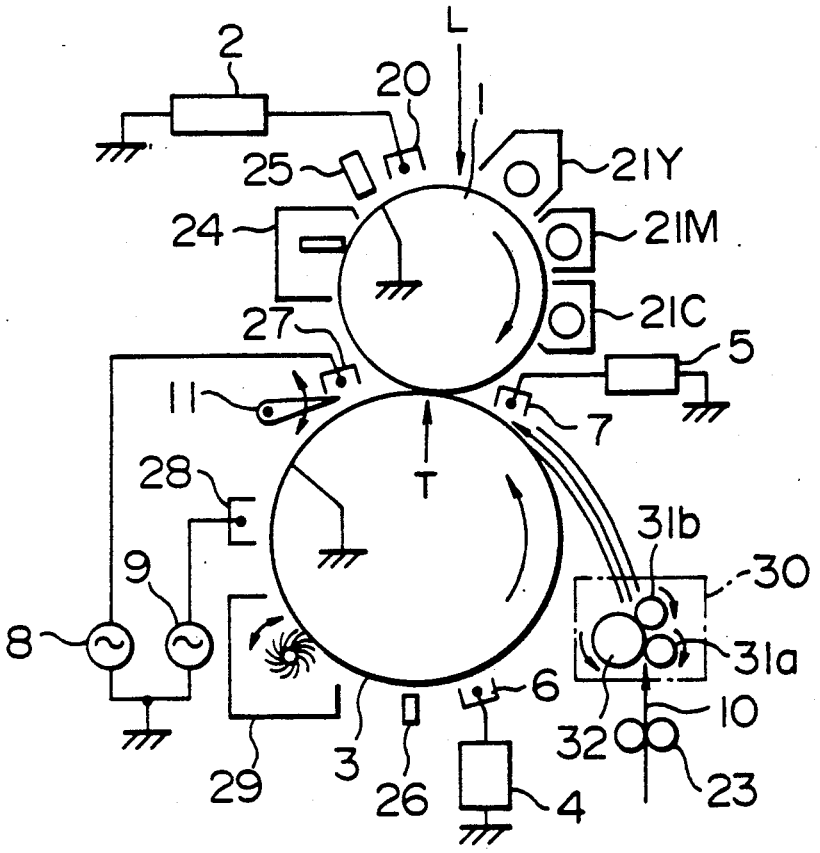
FIG. 1 is a schematic view of an image forming unit and an image transfer unit of a color laser printer using an image transfer apparatus according to the present invention.

Referring to FIG. 1, according to this Figure, a photosensitive drum 1 using, for example, an OPC photosensitive medium is rotated at a constant speed in the direction of an arrow by a drive motor (not shown). The outer peripheral surface of the photosensitive drum 1 is first uniformly electrically charged so as to have a negative polarity by a corona charger 20 fed electrically by a high voltage source 2. Then, the outer peripheral surface of the drum 1 is image exposed to a laser scanning light L following image information to be recorded so that an electrostatic latent image is formed on the surface of the drum 1.

A developing device inversely develops the electrostatic latent image using toners charged so as to have a negative polarity includes a yellow developing unit 21Y which uses a yellow toner as the developer, a magenta color developing unit 21M which uses a magenta color toner as the developer, and a cyan color developing unit 21C which uses a cyan color toner as the developer. These developing units are selectively used in accordance with image color information for controlling the operation of the laser scanning beam.

Recording paper 10 is fed by a transfer drum 3 to the position T where the toner image is transferred.

The recording paper 10 removed from a paper cassette and fed by feed rollers 23 enters a recording paper heating and curving unit 30 arranged such that the recording paper 10 is pressed against the outer periphery of a heating roller 32 by auxiliary rollers 31*a* and 31*b*, heated by the roller 32 and given a curved force along the outer periphery of the transfer drum 1. The heating roller 32 may be a heat roller used, for example, in a thermal fixing unit of an electrophotographic device. The recording paper 10 is heated and dried while passing through the recording paper heating and curving unit 30 and given a curve extending along the outer peripheral surface of the transfer drum 1. Preferably, the quantity of heat produced by the heating roller 32 is controlled in accordance with the hygroscopic state of the recording paper 10. More specifically, a temperature sensor and a humidity sensor are provided for converting the ambient temperature and humidity to corresponding electrical detection signals to thereby control a quantity of electric power fed to the heater in accordance with the magnitudes of the detection signals from the temperature sensor and the humidity sensor. The control of the fed quantity of electric power may be provided either in a two-step manner (in an heating and non-heating manner) or in a continuous manner. The two-step control may include controlling a power feeding switch (not shown) so as to be off or on in accordance with a control signal obtained by comparing respective reference values with the corresponding magnitudes of the detection signals. The continuous control may include controlling the on-off ratio of the power feeding switch in accordance with the magnitudes of the detection signals. Alternatively, the electrical resistance of the recording paper 10 may be detected by a contacting electrode (not shown) so as to similarly control the fed quantity of electric power.

The transfer drum 3 includes an insulated outer peripheral surface of a conductive body and is rotated in the direction of the arrow by a drive motor (not shown) at a speed synchronous with the photosensitive drum 1. The outer peripheral surface of the transfer drum 3 is electrically precharged by a corona charger 6, electrically fed by the high voltage source 4, so as to have a negative polarity, and heated and dried by the recording paper feeding and curving unit 30. The recording paper 10 having a curve extending along the outer peripheral surface of the transfer drum 1, is fed so as to be superimposed and electrostatically drawn on the charged outer peripheral surface of the transfer drum 3.

The corona charger 7, fed electrically by the high voltage source 5, applies electric charges having a positive polarity to the surface of the recording paper 10 drawn electrostatically to the outer peripheral surface of the transfer drum 3 to increase the electrostatic drawing force.

The recording paper 10 electrostatically drawn and held to the outer peripheral surface of the transfer drum 3 is pressed against the outer peripheral surface of the photosensitive drum 1 at the transfer position T such that a toner image formed on the outer peripheral surface of the photosensitive drum 1 is transferred electrostatically to the recording paper. Since the surface of the recording paper 10 is electrically charged so as to have a positive polarity, electrostatic transfer of the toner image obtained by inverse development with negatively charged toners is satisfactorily performed.

In color image recording, the recording paper 10 is repeatedly rotatably electrostatically drawn to the periphery of the transfer drum 3.

While the recording paper 10 is repeatedly rotated for color image recording, it is protected from the action of any of corona discharger 27 which is electrically fed by the high voltage AC source 8 to eliminate electric charges on the surface of the recording paper 10, a pawl 11 separates the recording paper 10 from the transfer drum 3, with a corona discharger 28 being electrically fed by a high voltage AC source 9 to eliminate electric charges on the outer surface of the transfer drum 3, a transfer drum cleaner 29 eliminates toners adhering to the outer peripheral surface of the transfer drum 3, with the paul 11, corona discharger 28 and drum cleaner 29 being disposed along the outer periphery on the transfer drum 3.

The toner remaining on the outer peripheral surface of the photosensitive drum 1 which has passed the transfer position T is eliminated by a photosensitive drum cleaner 24 while the remaining electric charges are eliminated by a charge eliminating unit 25, so that the photosensitive drum 1 is again used for the next toner image recording.

When the leading end of the recording paper 10 which repeatedly rotates while being electrostatically drawn by the transfer drum 3 passes the position of a recording paper sensor 26, an operation for recording the next color toner image starts.

For color image recording, the first toner image is formed using the yellow developing unit 21Y, the next toner image is formed using the magenta color developing unit 21M, and the final toner image is formed using the cyan color developing unit 21C. The respective color toner images are transferred one over another to the sheet of recording paper 10 which is repeatedly rotated while being electrostatically drawn by the transfer drum 3.

The electric charges on the recording paper 10 to which the final cyan color toner image has been transferred are eliminated by the corona discharger 27, separated by the pawl 11 from the outer peripheral surface of the transfer drum 3 and fed to the developing unit (not shown) for developing purposes. The toner images transferred one over another to the surface of the sheet of recording paper 10 fuse and the colors of the images mix during development to become a color image in a subtractive process.

The electric charges on the outer peripheral surface of the transfer drum 3 after separation of the recording paper 10 are eliminated by the corona discharger 28 and the remaining toners adhering to the outer surface of the transfer drum 3 are eliminated by a transfer drum cleaner 29 for reuse.

According to this laser beam printer, it is only required that a quantity of electric charges substantially equal to that on a sheet of 75 $g/m^2$ recording paper be applied to each of a sheet of 90 $g/m^2$ recording paper 10 and the transfer drum 3 (apart from the polarity of the electric charges) to electrostatically draw the sheet of 90 $g/m^2$ recording paper 10 securely onto the outer peripheral surface of the transfer drum 3 to thereby satisfactorily transfer the toner images formed on the outer peripheral surface of the photosensitive drum 1. Furthermore, this state is maintained even under high-temperature and high-humidity ambient conditions and stabilized against fluctuations of the ambient conditions.

While the color laser printer using yellow, magenta and cyan toners has been illustrated as an example, the color and number of toners and the number of developing units may be changed when required.

The polarities of electric charges on the transfer drum 3 and recording paper 10 in the present embodiment may be reversed, namely, the polarity of electric charges on the transfer drum 3 applied by the corona charger 6 may be positive while the polarity of electric charges on the recording paper 10 applied by the corona charger 7 may be negative, in order to obtain a result similar to that obtained by the present embodiment.

Figure 2:
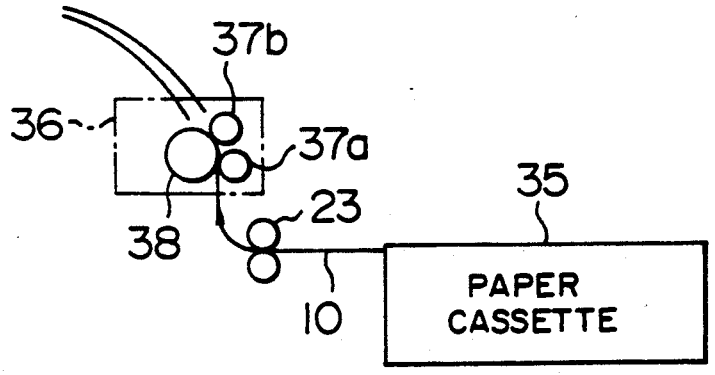
FIG. 2 is a schematic view of a drying and a curve forming means of a laser beam printer for performing a drying and a curve forming operation separately on recording paper.

As shown in FIG. 2 the recording paper 10 is removed from a paper cassette 35 and delivered to the feed rollers 23. The paper cassette 35 is arranged such that sheets of recording paper 10 accommodated within the paper cassette 35 are heated and dried. A curve forming unit 36 which forms is a curve in the recording paper 10 does not require a built-in heating means. A pair of auxiliary rollers **37*a* and 37*b* presses the recording paper 10 against the outer peripheral surface of the roller 38 to form a curve in the recording paper with the curve extending along the outer peripheral surface of the transfer drum 1**.

Since, in the present embodiment, the recording paper 10 is dried within the paper cassette 35, it can be performed over a relatively long time. Thus, the capacity of the power source may be reduced. Control of electric power fed to the cassette may also be provided similarly to the previous embodiment. Drying may be performed with a drying agent or the like in place of thermal drying.

As described above, according to the present invention, a curve extending along the outer peripheral surface of the transfer drum is preformed in the secondary recording medium, with the secondary recording medium being stably electrostatically drawn onto the outer peripheral surface of the transfer drum with a relatively small electrostatic drawing force.

The additional use of drying means serves to dry the secondary recording medium, so that the electric charges, applied to the secondary recording medium are maintained for a relatively long time to thereby maintain a stabilized electrostatic drawing force.

Therefore, no excessive electric charges are required to be applied, so that satisfactory toner image transfer characteristics are obtained.

What is claimed is:

1. An image transfer apparatus in an image recorder in which a toner image is formed on a surface of a photosensitive drum as a primary recording medium by uniform charging, image exposure and development, the toner image is transferred to a secondary recording medium electrostatically drawn to a transfer drum and the secondary recording medium is fixed to obtain an image record, the apparatus comprising:

recording medium heating and curving means for curving the secondary recording medium carried toward the transfer drum along an outer peripheral surface of the transfer drum while heating the secondary recording medium before the same is superimposed on the transfer drum.

2. An image transfer apparatus according to claim 1, wherein said recording medium heating and curving means includes a heating roller means for pressing the secondary recording medium.

3. An image transfer apparatus in an image recorder in which a toner image, formed on a surface of a primary recording medium, is transferred electrostatically to a secondary recording medium electrostatically drawn to a transfer drum, and the secondary recording medium is fixed to obtain an image record, the apparatus comprising:

recording medium heating and curving means for forming in the electrically charged secondary recording medium carried toward the transfer drum a curve extending along an outer peripheral curved surface of the transfer drum before the secondary recording medium is superimposed on the transfer drum, said recording medium heating and curving means includes a heating roller means for pressing the secondary recording medium; and a charger for applying electric charges to a surface of the secondary recording medium superimposed on the transfer drum.

4. An image transfer apparatus and an image recorder in which a toner image is formed on a surface of a photosensitive drum as a primary recording medium by uniform charging, image exposure and inverse development, the toner image is electrostatically transferred to a secondary recording medium electrostatically drawn to a transfer drum, a secondary recording medium is fixed to obtain an image record, the apparatus comprising:

recording medium heating and curving means for forming in the secondary recording medium carried toward the transfer drum a curve extending along an outer peripheral surface of the transfer drum while heating the secondary recording medium before the same is superimposed on the transfer drum; and a charger for applying electric charges to a surface of the secondary recording medium superimposed on the transfer drum, said electric charges having a polarity opposite to that of electric charges of the toner image.

* * * * *